US006657422B2

(12) United States Patent
Heyne et al.

(10) Patent No.: US 6,657,422 B2
(45) Date of Patent: Dec. 2, 2003

(54) CURRENT MIRROR CIRCUIT

(75) Inventors: Patrick Heyne, München (DE); Thilo Marx, Villingen-Schwenningen (DE); Thomas Hein, München (DE); Torsten Partsch, Chapel Hill, NC (US)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/033,877

(22) Filed: Dec. 27, 2001

(65) Prior Publication Data

US 2002/0089319 A1 Jul. 11, 2002

(30) Foreign Application Priority Data

Dec. 27, 2000 (DE) ..... 100 65 379

(51) Int. Cl.[7] ..... G05F 3/20
(52) U.S. Cl. ..... 323/313
(58) Field of Search ..... 323/313, 314, 323/315, 312, 311; 327/403, 530, 538

(56) References Cited

U.S. PATENT DOCUMENTS 4,583,037 A * 4/1986 Sooch ..... 323/315
4,740,743 A * 4/1988 Reisinger et al. ..... 323/316
5,021,692 A * 6/1991 Hughes ..... 307/490
5,204,612 A * 4/1993 Lingstaedt ..... 323/317
5,644,269 A * 7/1997 Wong et al. ..... 330/261
5,672,993 A * 9/1997 Runaldue ..... 327/404

FOREIGN PATENT DOCUMENTS

JP 6-4162 1/1994

OTHER PUBLICATIONS

Tietze, U. et al.: "Halbleiter–Schaltungstechnik" (semiconductor circuit–technique), Springer–Verlag, vol. 10, 1993, pp. 94–97 No date.

* cited by examiner

*Primary Examiner*—Rajnikant B. Patel
(74) *Attorney, Agent, or Firm*—Laurence A. Greenberg; Werner H. Stemer; Ralph E. Locher

(57) ABSTRACT

A current mirror circuit has an input path, which has a current source and, connected in series therewith, a first transistor circuit with at least two transistors, wherein one of the transistors can be connected in parallel with the other of the transistors. In an output path, which has a second transistor circuit with at least two transistors, one of the transistors can be connected in parallel with the other of the transistors. The control terminals of the transistors of the first and second transistor circuits can be connected to the input path. As a result, the current mirror circuit can be changed over between two operating modes with a different current requirement with comparatively short changeover times.

10 Claims, 2 Drawing Sheets

CURRENT MIRROR CIRCUIT

BACKGROUND OF THE INVENTION

1. Field of the Invention

The present invention relates to a current mirror circuit. In integrated circuits, current mirror circuits are used for example for realizing constant-current sources. In a basic circuit, a current mirror circuit has, in principle, an input path and an output path, which are coupled to one another. The input path generally contains a current source with which a transistor is connected in series by its main current path. The output path contains a further transistor, the control terminal of which is connected to the input path. Equally, the control terminal of the first transistor is connected to the input path.

A basic circuit of that type is described, for example, in Tietze, Schenk: Halbleiter-Schaltungstechnik [Semiconductor Circuitry], 10th Ed., Springer-Verlag, Berlin, 1993, pages 94–97. If both transistors are identical, in particular their width-length ratios, the same current flows through both transistors and thus through the input path and the output path. The current through the respective transistor is determined in particular by the gate-source voltage, and equally by the width-length ratio of the respective transistor. Given the same gate-source voltage, the magnitude of the current which flows through the transistors is generally proportional to its width-length ratio.

Current mirror circuits are used in particular as current sources for data receiver circuits, so-called data receivers. It is thereby generally desirable to operate the data receiver in a plurality of operating modes, for instance in a normal operating mode and a standby operating mode. The latter is characterized by a lower current requirement relative to the normal operating mode.

If the current of the current source, for instance, changes in a current mirror circuit, for example on account of a change in the operating mode, then, in particular, the gate-source voltage of the respective transistor in the input path and output path changes as a result. The temporal change is thereby dependent inter alia on line capacitances and so-called buffer capacitances. In the circuitry, comparatively large buffer capacitances are often used in order that the current of the current mirror circuit is kept constant in an operating mode and so-called noise is minimized. However, on account of long time constants that result, this leads to comparatively long changeover times for example when changing over from the standby operating mode to the normal operating mode.

SUMMARY OF THE INVENTION

It is accordingly an object of the invention to provide a current mirror circuit, which overcomes the above-mentioned disadvantages of the heretofore-known devices and methods of this general type and which, in the event of current changes in the current source, can be changed over for example from a normal operating mode to an operating mode with a reduced current requirement with comparatively short changeover times.

With the foregoing and other objects in view there is provided, in accordance with the invention, a current mirror circuit, comprising:

an input path with a current source and a first transistor circuit connected in series with the current source, the transistor circuit having a first transistor and a second transistor, and the second transistor can be connected in parallel with the first transistor;

an output path with a second transistor circuit having a first transistor and a second transistor, and the second transistor can be connected in parallel with the first transistor; and the transistors of the first and second transistor circuits having control terminals that can be connected to the input path.

In other words, the objects of the invention are achieved by means of a current mirror circuit having an input path, which has a current source and, connected in series therewith, a first transistor circuit with at least two transistors, in which one of the transistors can be connected in parallel with the other of the transistors, having an output path, which has a second transistor circuit with at least two transistors, in which one of the transistors can be connected in parallel with the other of the transistors, and in which the control terminals of the transistors of the first and second transistor circuits can be connected to the input path.

The current mirror circuit according to the invention makes it possible to influence the gate-source voltage of the transistors in the input path and output path in the event of current changes in the current source by corresponding connection or disconnection of the connectable transistors in the input path and output path of the current mirror circuit. In particular, this can be controlled by corresponding connection or disconnection of the respective transistor in such a way that no fluctuations, or only comparatively slight fluctuations, of the gate-source voltage occur, even if the respective current changes in the input path and output path of the current mirror circuit. Consequently, there is no need to carry out charge reversal operations for example of line capacitances or buffer capacitances. This enables the current mirror circuit to be operated in two different operating modes, which differ in terms of the current requirement, with comparatively short changeover times.

For this reason, the current mirror circuit according to the invention can advantageously be used as a current source for a data receiver. These can be operated in a standby operating mode with a reduced current requirement, so that the power demand of, for example, an integrated circuit in the form of an integrated memory is reduced in this operating mode. With the current mirror circuit according to the invention as current source, the data receiver can be operated in the normal operating mode with a comparatively short changeover time.

In one embodiment of the current mirror circuit according to the invention, the connectable transistors of the respective transistor circuits are connected in the normal operating mode and disconnected in a standby operating mode. The disconnection of the corresponding transistor of the first transistor circuit makes it possible to ensure that even in the event of a reduced current in the input path, the gate-source voltage of the other transistor remains unchanged. In order to maintain the ratio of input current and output current, the corresponding transistor of the second transistor circuit is then likewise disconnected.

In accordance with an added feature of the invention, a ratio of the width-length ratios of the transistors of the first transistor circuit corresponds to a corresponding ratio of the width-length ratios of the transistors of the second transistor circuit. In one embodiment, the connectable transistors of the first and second transistor circuits have an identical width-length ratio.

In an advantageous embodiment of the invention, the current source is formed by a third transistor circuit, which has at least two transistors whose main current paths are connected to the input path, wherein one of the transistors can be connected in parallel with the other of the transistors. The current in the input path of the current mirror circuit can be changed through the connection or disconnection of the corresponding transistor of the third transistor circuit.

In accordance with a particularly advantageous feature, a ratio of the width-length ratios of the transistors of the first transistor circuit corresponds to a corresponding ratio of the width-length ratios of the transistors of the third transistor circuit. This enables the gate-source voltage of a transistor of the second transistor circuit to be influenced to the same extent as the change of the current in the input path through the third transistor circuit. In one embodiment, the connectable transistors of the first and third transistor circuits have an identical width-length ratio. In this case, through parallel connection and disconnection of identical transistors, the current in the input path and output path is changed without a change in the respective gate-source voltage of the transistors in the input path and output path.

Other features which are considered as characteristic for the invention are set forth in the appended claims.

Although the invention is illustrated and described herein as embodied in current mirror circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
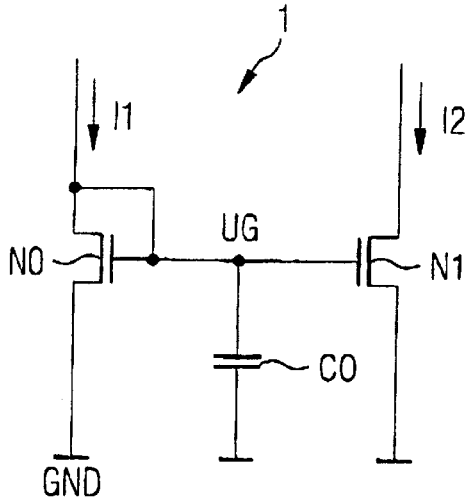
FIG. 3 is a schematic of a basic circuit of a current mirror circuit.

Referring now to the figures of the drawing in detail and first to FIG. 3 thereof, there is shown a basic circuit of a current mirror circuit 1, whose input path contains a transistor N0 and whose output path contains a transistor N1. The control terminal of the transistor N1 is connected to the input path and to the control terminal of the transistor N0. Equally, the control terminal of the transistor N0 is connected to the input path. If both transistors N0 and N1 are identical, in particular if these transistors have an identical width-length ratio, respective currents having an identical magnitude flow through both transistors. In other words, the magnitude of the current I1 corresponds to the magnitude of the current I2.

The currents I1 and I2 are determined in particular by the level of the gate-source voltage of the transistors N0 and N1. In order that, in a normal operating mode, for example, the respective currents I1 and I2 are kept constant and noise is minimized, a buffer capacitance C0 is provided, which is connected to the control terminals of the transistors N0 and N1. As a result, a buffered voltage UG is established, so that the gate-source voltage of the transistors N0 and N1 is subjected to comparatively minor fluctuations. However, if the current I1 changes in a standby mode, for example, then the voltage UG has a comparatively high time constant on account of charge reversal operations. This results in comparatively long changeover times between a normal mode and a standby mode with a reduced current requirement, and vice versa.

Figure 1:
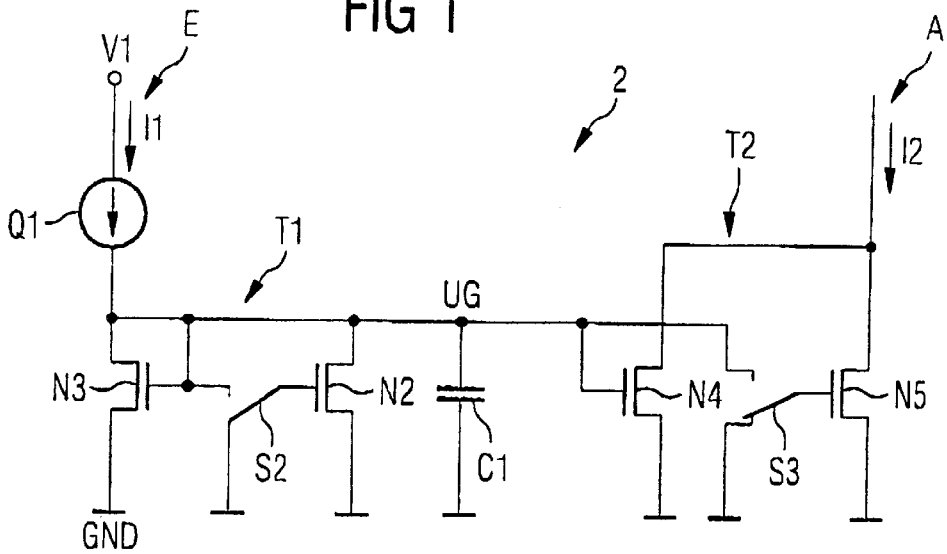
FIG. 1 is a circuit schematic of an embodiment of a current mirror circuit according to the invention.

FIG. 1 shows an embodiment of a current mirror circuit 2 according to the invention. The novel current mirror circuit has an input path E, which contains a current source Q1 and, connected in series therewith, a transistor circuit T1 with two NMOS transistors N2 and N3. In this case, the transistor N2 can be connected in parallel with the transistor N3 via a switch S2. The two control terminals of the transistors N2 and N3 are thereby connected to the input path E of the current mirror circuit 2, so that these have an identical gate-source voltage. The input path E is connected to the supply potentials V1, which corresponds to a positive supply voltage for example, and GND, which corresponds to a reference-ground potential for example. An output path A of the current mirror circuit 2 has a transistor circuit T2 containing two NMOS transistors N4 and N5. In this case, the transistor N5 can be connected in parallel with the transistor N4 by means of the switch S3. The control terminals of the transistors N4 and N5 are thereby connected to the input path E. As a result, both transistors have the same gate-source voltage.

The state of the switches S2 and S3 in FIG. 1 corresponds to the state in the standby operating mode of the current mirror circuit 2. In other words, the transistors N2 and N5 are disconnected. If the current I1 changes toward higher values on account of a changeover from the standby operating mode to a normal operating mode, then a rise in the voltage UG at the node of a buffer capacitance C1 is prevented by the transistors N2 and N5 being connected by means of the switches S2 and S3. As a result, the total resistance of the transistor circuits T1 and T2 decreases, so that the voltage UG does not change. Consequently, charge reversal of the buffer capacitance C1 is not necessary, thus resulting in comparatively short changeover times between the normal mode and the standby mode.

The connection of the transistor N5 ensures that the current I2 also increases with the current I1. In this case, the ratio of the width-length ratio (designated as W-L below) of the transistor N4 to the width-length ratio of the transistor N5 corresponds to the ratio of the width-length ratio (W-L) of the transistor N3 to the width-length ratio (W-L) of the transistor N2.

$$W\text{-}L(N3)-W\text{-}L(N2)=W\text{-}L(N4)-W\text{-}L(N5)$$

In particular, in this case the width-length ratio of the transistor N3 corresponds to the width-length ratio of the transistor N4, and the width-length ratio of the connectable transistor N2 is equal to the width-length ratio of the transistor N5. This ensures that, given a constant UG, the ratio of the currents I1 and I2 remains unchanged both in the normal operating mode and in the standby operating mode. If the current I1 in the standby mode is intended to be halved, for example, relative to the normal mode, then the width-length ratio of the transistor N3 corresponds to the width-length ratio of the transistor N2.

Figure 2:
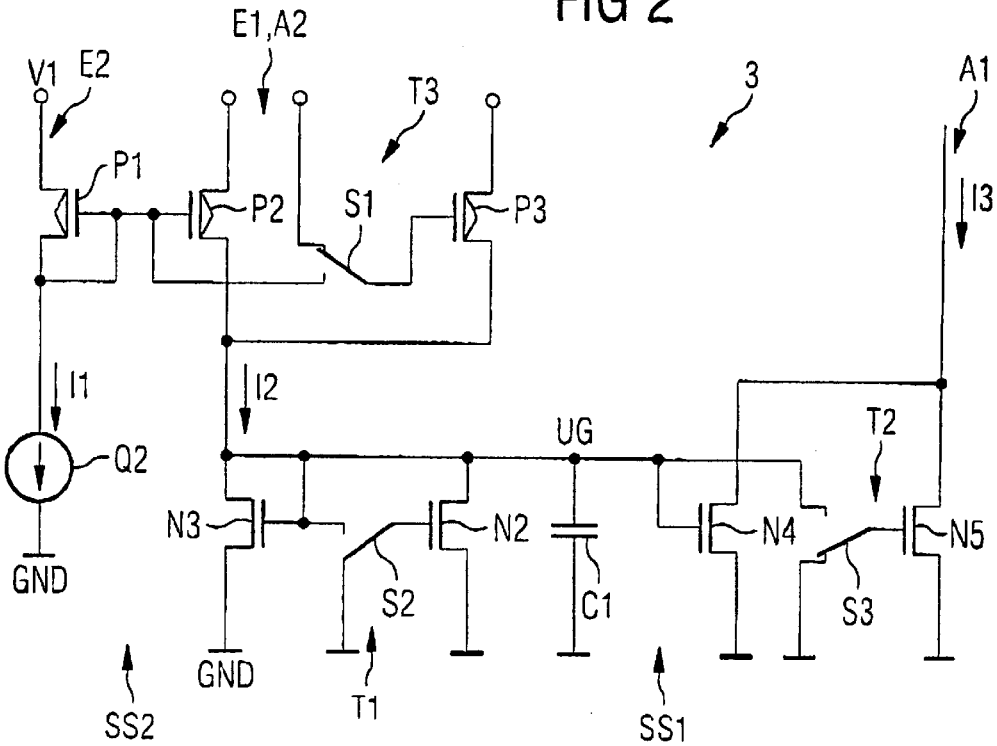
FIG. 2 is a circuit schematic of a further embodiment of a current mirror circuit according to the invention.

FIG. 2 shows an embodiment of a current mirror circuit 3 according to the invention, which is formed in the form of two current mirrors SS1 and SS2 connected in series with one another. In terms of its basic construction, the current mirror SS1 in this case corresponds to the current mirror circuit 2 in accordance with FIG. 1. The current source Q1 therein is formed by a transistor circuit T3, having the PMOS transistors P2 and P3, in accordance with the circuit according to FIG. 2. The transistor P3 can be connected in parallel with the transistor P2 by means of a switch S1. The input path E1 of the current mirror SS1 simultaneously forms the output path A2 of the current mirror SS2. The input path E2 thereof has a transistor P1 and a reference current source Q2. If the transistor P3 is connected in parallel with the transistor P2, the two control terminals of these transistors are connected to the input path E2 of the current mirror SS2. The current I2 is adjustable with regard to the current I1 by means of the transistor circuit T3. The current I3 can be drawn via the output path A1 of the current mirror SS1.

The illustration in accordance with FIG. 2 shows an operating state for a standby mode of the current mirror circuit 3. The transistors P2 and P3 each have half a width-length ratio with regard to the width-length ratio of the transistor P1. Consequently, I2=½ I1 comes about. Accordingly, given identical transistors N3 and N4, I3=I2=½ I1.

In a normal operating mode of the current mirror circuit 3, the switches S1 to S3 each change their states. As a result I2=I1 comes about. In the case where the transistors N2 and N5 or the width-length ratios thereof correspond to those of the transistors N3 and N4, the voltage UG remains constant even in the event of a doubled I2. Accordingly, with transistors N2 and N5 connected, the current I3=I2=I1. In order that the voltage UG remains constant in the event of an altered I2, the ratio of the width-length ratios of the transistors N2 and N3 should correspond to the ratio of the width-length ratios of the transistors P3 and P2.

$$W\text{-}L(N2)-W\text{-}L(N3)=W\text{-}L(P3)-W\text{-}L(P2)$$

In particular, the width-length ratio of the transistor P3 in this case corresponds to the width-length ratio of the transistor N2.

Figure 4:
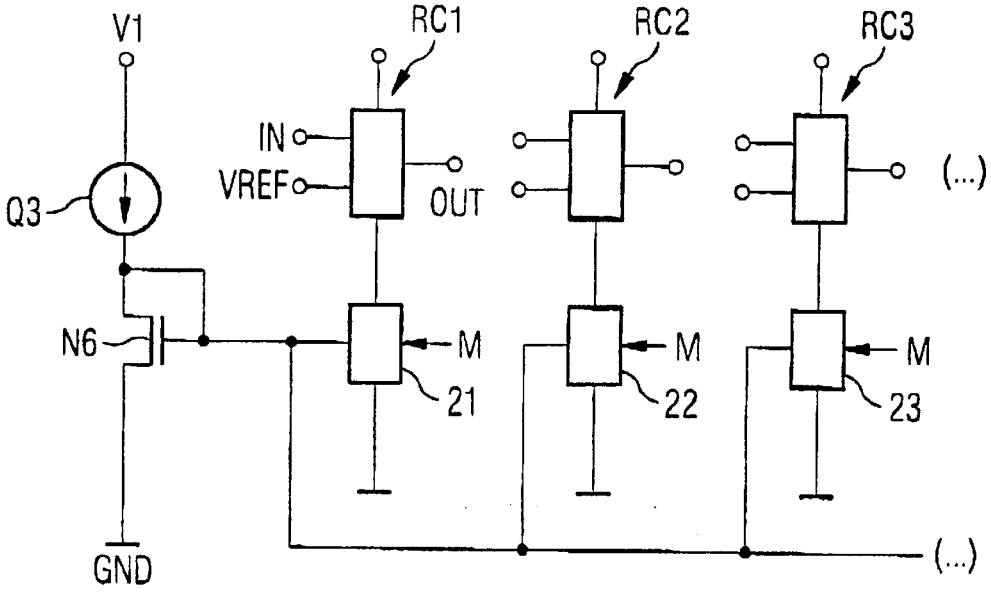
FIG. 4 is a circuit diagram with a plurality of current mirror circuits in the use as current sources for respective data receivers.

FIG. 4 shows a circuit arrangement having a plurality of data receiver circuits RC1 to RC3. The latter each have an input signal IN and a reference voltage VREF, from which an output signal OUT is generated in each case. The data receiver circuits RC1 to RC3 are supplied by respective current sources 21 to 23. The latter each contain a current mirror circuit in accordance with FIG. 1 or FIG. 2. For setting the respective reference current, the current sources 21 to 23 are driven by a series circuit comprising a current source Q3 and a transistor N6. By means of respective mode signals M, the current sources 21 to 23 can be changed over between a normal mode and a standby mode through control by corresponding switches such as S1 to S3 in accordance with FIGS. 1 and 2. The current requirement of the respective data receiver circuit is thus reduced in a standby mode.

We claim:

1. A current mirror circuit, comprising:

an input path with a current source and a first transistor circuit connected in series with said current source, said first transistor circuit having a first transistor, a second transistor, and a first switch for connecting said second transistor in parallel with said first transistor;

an output path with a second transistor circuit having a first transistor, a second transistor, and a second switch for connecting said second transistor in parallel with said first transistor; and said transistors of said first and second transistor circuits having control terminals to be connected to said input path.

2. The current mirror circuit according to claim 1, wherein:

said transistors of said first and second transistor circuits have a width-length ratio; and a ratio of said width-length ratios of said first and second transistors of said first transistor circuit corresponds to a ratio of the width-length ratios of said first and second transistors of said second transistor circuit.

3. The current mirror circuit according to claim 1, wherein said second transistors of said first and second transistor circuits have an identical width-length ratio.

4. The current mirror circuit according to claim 1, wherein said current source is formed by a third transistor circuit having at least two transistors with main current paths connected to said input path, and wherein one of said transistors of said third transistor circuit to be connected in parallel with the other of said transistors of said third transistor circuit.

5. The current mirror circuit according to claim 4, wherein a ratio of width-length ratios of said first and second transistors of said first transistor circuit corresponds to a ratio of width-length ratios of said first and second transistors of said third transistor circuit.

6. The current mirror circuit according to claim 4, wherein said second transistors of said first and third transistor circuits have an identical width-length ratio.

7. The current mirror circuit according to claim 4, wherein:

said input path and said output path form a first current mirror; and including a second current mirror connected in series with said first current mirror, said second current mirror having an output path connected into said input path of said first current mirror; and said second current mirror having an input path with a reference current source, said second current mirror to be connected to said control terminals of said transistors of said third transistor circuit.

8. The current mirror circuit according to claim 4, wherein said second transistors of said first, second, and third transistor circuits are connected in a normal operating mode of the current mirror circuit and disconnected in a standby operating mode.

9. The current mirror circuit according to claim 1, wherein said second transistors of said first and second transistor circuits are connected in a normal operating mode of the current mirror circuit and disconnected in a standby operating mode.

10. The current mirror circuit according to claim 1 configured in a current source for a data receiver circuit.

* * * * *